US005083487A

United States Patent [19]

Croteau

[11] Patent Number: 5,083,487

[45] Date of Patent: Jan. 28, 1992

[54] HIGH SPEED PERFORATION MACHINE FOR PERFORATING PREDETERMINED REPETITIVE PATTERNS IN A CONTINUOUS MOVING WEB

[75] Inventor: Rene Croteau, Lonqueuil, Canada

[73] Assignee: Converdis Inc., Berthierville, Canada

[21] Appl. No.: 393,788

[22] Filed: Aug. 15, 1989

[30] Foreign Application Priority Data

Aug. 8, 1989 [CA] Canada ..... 608708

[51] Int. Cl.[5] ..... B26F 1/26

[52] U.S. Cl. ..... 83/29; 83/38; 83/53; 83/76; 83/94; 83/177; 83/364; 83/370; 83/428

[58] Field of Search ..... 83/177, 27, 50, 40, 83/55, 86, 76.8, 53, 364, 365, 428, 41, 923, 370, 298, 508, 29, 94, 96, 104, 76.2, 76

[56] References Cited

U.S. PATENT DOCUMENTS

| | | | |
|---|---|---|---|
| 2,458,538 | 1/1949 | Socke | 83/923 X |
| 3,226,527 | 12/1965 | Harding | 83/177 X |
| 3,589,221 | 6/1971 | Deegan | 83/41 |
| 3,717,538 | 2/1973 | Hartung | 83/29 X |
| 3,753,381 | 8/1973 | Reime et al. | 83/364 |
| 3,807,261 | 4/1974 | Couvreur | 83/76 X |
| 3,978,748 | 9/1976 | Leslie et al. | 83/177 X |
| 4,266,112 | 5/1981 | Niedermeyer | 83/177 X |
| 4,404,634 | 9/1983 | Bautz | 83/365 X |
| 4,543,863 | 10/1985 | Rader | 83/76 |
| 4,620,466 | 11/1986 | Jumel | 83/53 X |
| 4,833,957 | 5/1989 | Lundgren | 83/365 X |

*Primary Examiner*—Mark Rosenbaum
*Assistant Examiner*—Rinaldi Rada
*Attorney, Agent, or Firm*—Oblon, Spivak, McClelland, Maier & Neustadt

[57] ABSTRACT

An method and an apparatus for high speed cutting, a predetermined repetitive pattern in a continuous moving web of material. The web is supported and displaced in a flat plane, and a sensor is utilized to detect the lateral position of the web on this plane. At least one cutting element, herein a high pressure water jet, is displaceably supported for movement on two transverse axes in a horizontal plane adjacent a face of the web and generates a cutting beam to cut a predetermined repetitive pattern through the web. The cutting element is secure to a guide member which is displaced in the horizontal plane adjacent the web, and its displacement and rate of speed are controlled by a control device.

11 Claims, 4 Drawing Sheets

HIGH SPEED PERFORATION MACHINE FOR PERFORATING PREDETERMINED REPETITIVE PATTERNS IN A CONTINUOUS MOVING WEB

BACKGROUND OF INVENTION

1. Field of Invention

The present invention relates to a method and apparatus for high speed cutting a repetitive pattern in a continuous moving web of material whereby to cut out or score straight or configured lines within the web and with minimum material loss. Preferably, but not exclusively, the cutting elements are high speed water jets which are supported for movement on two transverse axes adjacent in a horizontal plane adjacent the moving web.

2. Description of Prior Art

Various types of devices are known for cutting a pattern into sheets of material whereby to form configured pieces. The majority of these machines are, however, only semi-automatic and still require personnel to effect the cutting operation as well as the unloading of the cut pieces and the discharge of cuttings. Such machines are, therefore, time and labor consuming, and often subject to human error. Accordingly, it is not always possible to cut configured pieces which are identical, and this causes further problems, as can well be imagined.

With prior art devices many of the cutting elements utilized are mechanical dies, and these often wear out and require replacement. They are also not versatile in that the configuration of the die cannot be modified. If a different shape is required, one must produce a completely new die. The cutting elements also wear out and do not provide precise cutting edges, thus producing tearing and jaggered edges in the configured pieces when the cutting blade becomes worn. These prior art apparatuses also produce dust when cutting material such as cardboard, and thereby necessitate special enclosures for the equipment as well as providing a health hazard to the operators. A main disadvantage of such prior art machines is that they are not flexible in that they require excessive set-up time each time a different configuration is need. Therefore, the fabrication becomes more expensive. Prior art machine also do not provide automatic continuous pattern cutting with the web in a continuous feed. Also, there is no automatic adjustment for correction of the misalignment of the web.

SUMMARY OF INVENTION

It is a feature of the present invention to provide a method and an apparatus for high speed, automatic cutting of a predetermined repetitive pattern in a continuous moving web of material, and which substantially overcomes all of the above-mentioned disadvantages of the prior art.

Another feature of the present invention is to provide a method and apparatus for high speed, automatic cutting of a predetermined repetitive pattern in a continuous moving web of material, and which utilizes high pressure water jets to effect the cutting thereby always providing a clean cut and eliminating dust.

Another feature of the present invention is to provide a method and apparatus, as above referred to, and wherein the apparatus is controlled by a computer capable of modifying the predetermined repetitive pattern or cutting different repetitive patterns simultaneously in the moving web and at high speed.

According to the above features, from a broad aspect, the present invention provides a high speed cutting machine for cutting a predetermined repetitive pattern in a continuous moving web of material. The apparatus comprises conveyor means to support and displace the web in a flat plane. Sensing means is provided to sense the lateral position of the web on the conveyor means. Speed sensing means senses the speed of displacement of the web on the conveyor means. At least one cutting element is each displaceably supported for movement on two transverse axes along a predetermined path in a horizontal plane adjacent a face of the web, and generate a cutting beam to cut a repetitive pattern through the web. Guide means is provided to support the cutting element for displacement in the horizontal plane adjacent the web which is displaced on the conveyor means. Control means is also provided to control the displacement and rate of speed of the cutting element dependent on the rate of displacement and the lateral position of the web on the conveyor means.

According to a still further broad aspect of the present invention, there is provided a method of cutting a predetermined repetitive pattern in a continuous moving web of material. The method comprises supporting a moving web in a flat plane of a conveyor means. The position and the speed of the web is sensed. The lateral position of the web is detected in the flat plane. At least one cutting element is displaced on two transverse axes in a horizontal plane adjacent a face of the web and on guide means. A cutting beam is generated by the cutting element to perforate the repetitive pattern through the web. The displacement and rate of speed of the cutting elements are controlled by a computer dependent on the rate of displacement and the lateral position of the web on the conveyor means.

BRIEF DESCRIPTION OF DRAWINGS

A preferred embodiment of the present invention will now be described with reference to the accompanying drawings, in which.

DESCRIPTION OF PREFERRED EMBODIMENTS

Figure 1:
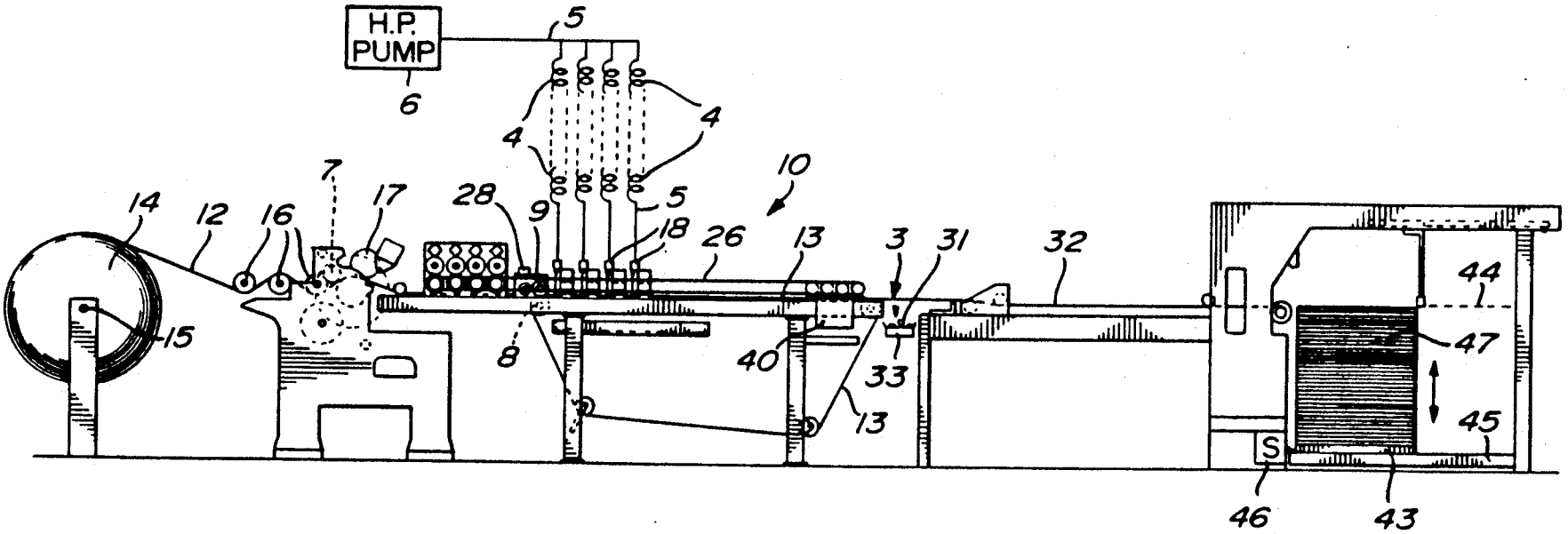
FIG. 1 is a simplified side view of the high speed perforation machine of the present invention.
Figure 2:
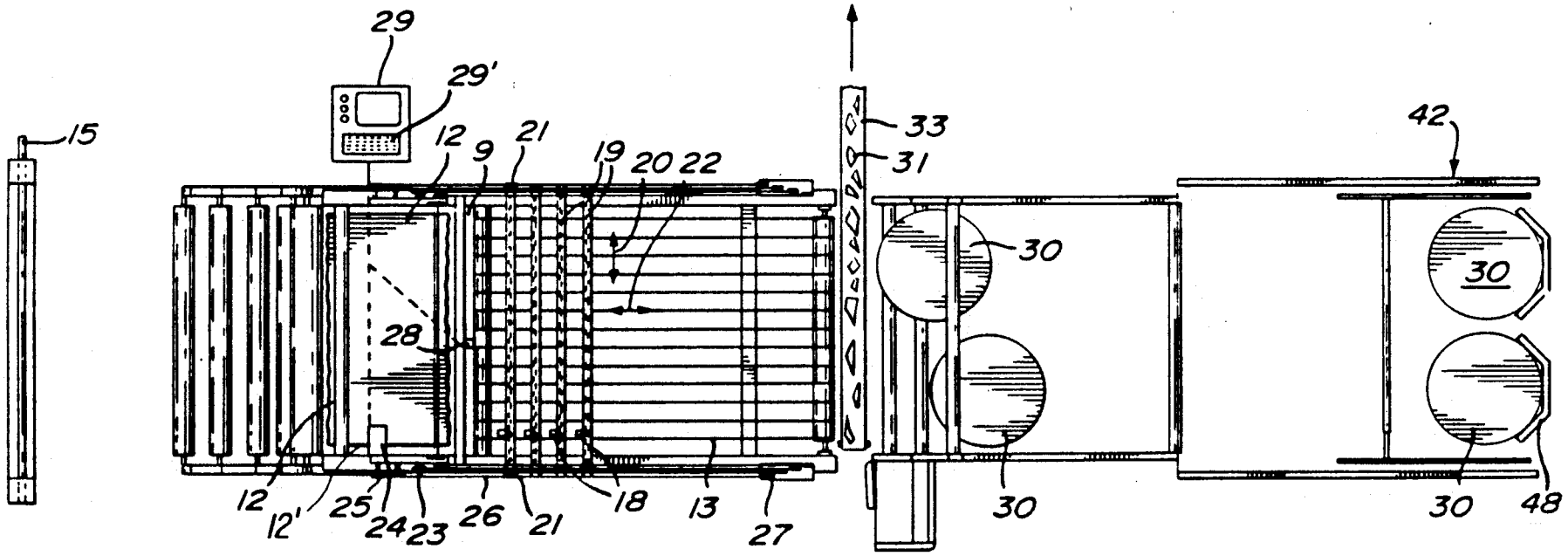
FIG. 2 is a top view of FIG. 1.

Referring now to the drawings, and more particularly to FIGS. 1 and 2, there is generally shown at 10 the high speed cutting machine of the present invention for cutting a predetermined repetitive pattern, such as those shown in FIGS. 5A to 5F and herein denoted by reference numeral 11, in a continuous moving web of material 12. The apparatus comprises a main conveyor 13 consisting of support conveyor wires trained about pulleys 8 for supporting and displacing the web in a flat horizontal plane.

As herein shown, the web 12 is a cardboard web taken up from a large supply roll 14 supported on a shaft 15 at a feed end of the machine. Guide rolls 16 feed the web 12 to pincer rolls 17 which effect the feeding or drive of the web over the wire conveyor 13. The feed speed is controlled by the speed of the rolls 17. The web is directed under at least one cutting elements, herein four cutting elements 18, each of which is independently displaceable laterally of the web 12 on respective guide rails 19 whereby each of the cutting elements 18 can be positioned along a Y-axis, as indicated by direction arrow 20. This is done by a belt-and-pulley system 21 disposed at the end of each rail (see FIG. 3). Each of the rails 19 is supported on end pedestals and is also independently movable in the machine direction or longitudinally of the machine, as indicated by direction arrow 22. This is also done by a belt-and-pulley system 23, herein shown in simplified form, but consisting essentially of a motor 24 driving a drive sprocket 25 to displace a cable or belt 26 secured to a particular one of the guide rails 19, and about an idle sprocket 27. Such drive arrangements are fairly well known in the art. Accordingly, the cutting elements are displaceable along two transverse axis in a horizontal place. The cutting elements are fed to a supply of water by a high pressure pump 6 connected to each cutting element 18 via feed lines 5 provided with expander coil tubes 4 to permit displacement of the cutting elements 18.

In order to sense the precise position of the web 12 relative to the support surface or the conveyor wires 13, there is provided a sensor 28 which is also displaceable on a transverse bridge 9, and it consists of photoelectric cells which sense the position of the edge, such as the side edge 12'(see FIG. 2) of the web 12, so that the cutting elements, herein the water jet elements 18, are precisely positioned on their respective rails with respect to this edge portion of the web. This provides compensation for shifting of the web on the support surface. A sheet displacement sensing wheel 7 is provided adjacent the pincer rolls 17 to sense the speed of the web. This sensor 17 as well as sensor 28 feed information signal to control means in the form of a computer console 29, which controls the entire operation of the machine. The console 29 also permits the selection of desired patterns or configured piece to be cut by the machine.

Figure 4:
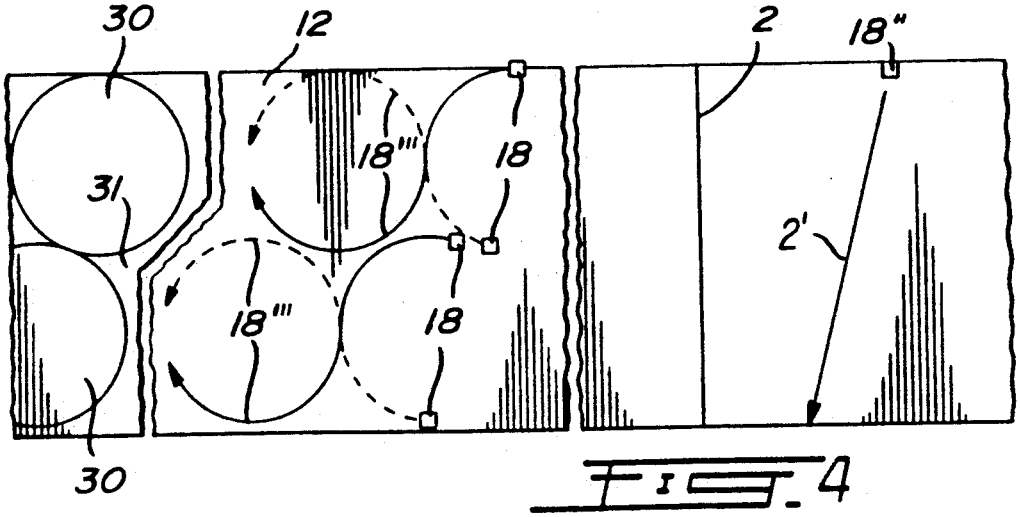
FIG. 4 is a plan view of the web showing the displacement of various cutting elements to cut predetermined repetitive patterns such as circular discs or a straight cut in the web.

As shown in FIG. 4, the configured pieces being cut from the web 12, which is a web 12 of cardboard material, are circular discs 30, and these discs are positioned adjacent to each other and offset whereby to minimize the material loss, that is to say, to reduce the cuttings 31 to a minimum. However, these cuttings 31 must be removed from the main conveyor carrying the discs 30 and discharged separately. This is achieved by positioning a discharge conveyor 33 at the end of the conveyor 13.Because there is a space 3 at the end of the conveyor 13, the cuttings will fall at the end of the main conveyor 13 and onto the discharge conveyor 33 where the cuttings will be transported away from the machine. A further belt conveyor 32 transport the discs 30 to loading station 42 where they are guided onto a support pallet 43 which is progressively lowered from the plane 44 of the conveyor and down to an unloading platform 45 where a switch 46 is actuated to stop the machine permitting unloading of the stacks 47. A counter may also be used to stop the machine. Suitable guide walls, such as 48, are provided in order to guide the pieces 30 over the previously positioned pieces on the stacks.

Figure 3:
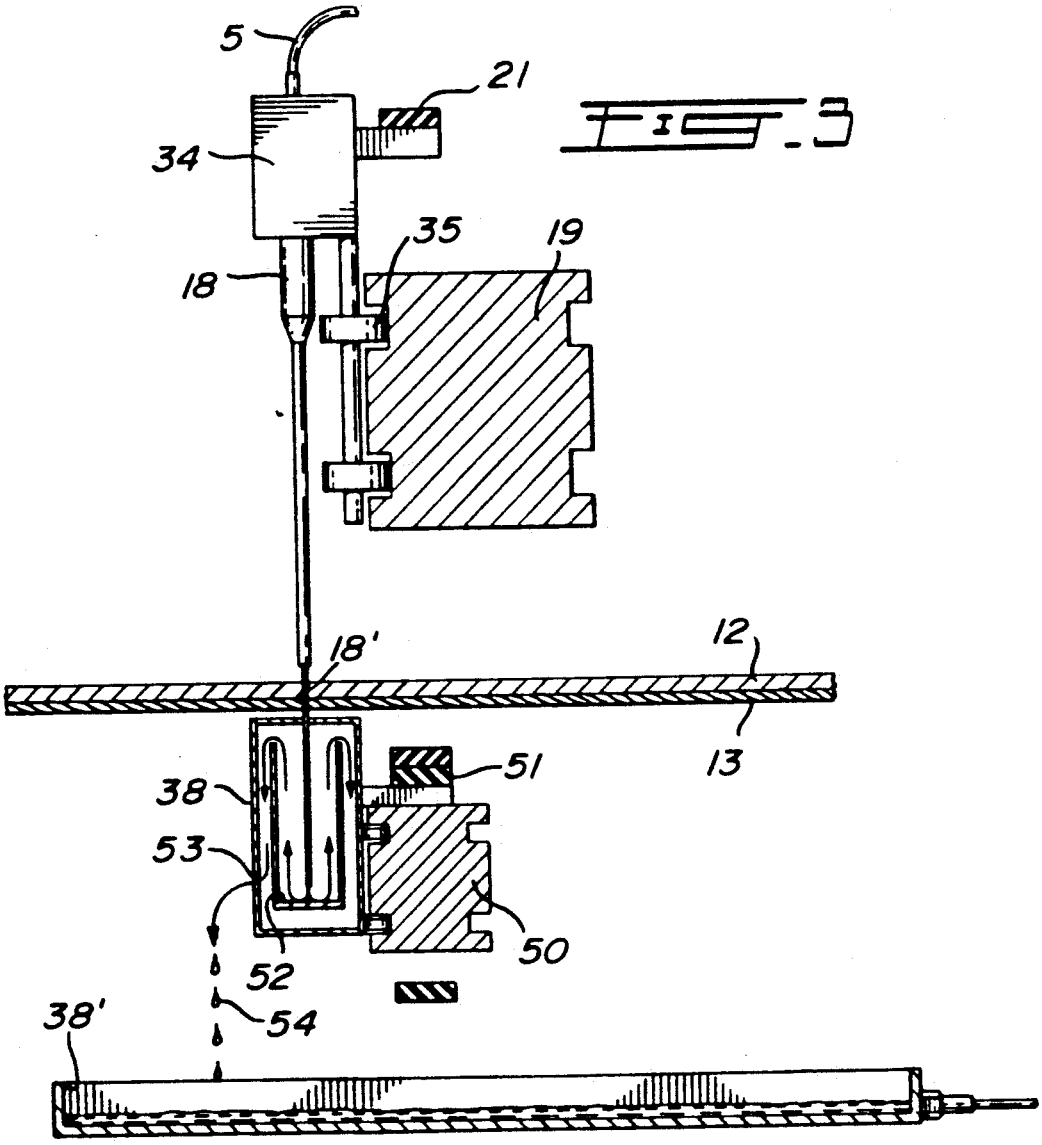
FIG. 3 is a simplified view, partly fragmented of the cutting elements and the catcher follower housing.

Referring additionally now to FIG. 3, it can be seen that the high pressure water jet nozzles 18 are secured to carriages 34 displaceably supported by wheels 35 on the rails 19, and each of the jet elements 18 is connected by a flexible conduit 5 to the high pressure water supply line 5 connected to the pump 6. A catcher follower housing 38 is also secured to a support rail 50 which is coupled to the rail 19 and displaced therewith. The housing 38 is also displaced along the rail 50 by a belt and pulley system 51 coupled to the belt and pulley system 21. Thus, the housing 38 always remains aligned with the jet stream 18'of the cutting element 18. The catcher follower housing is provided with a jet stream arresting box on wall 52 on which the jet stream strikes and the overflow is directed to a drip hole 53 where water falls in droplets 54 into a collector 38' under the conveyor 13.

By using wire conveyors 13 the trajectory of the jets is not affected and a clean cut is made in the web. Also, the water can be collected under the support plane of the conveyors by the catcher follower housings 38. As also shown in FIG. 4, the cutting elements 18, herein four of them, are displaced in synchronism with the moving web 12, and their pressurized water stream, which is a hair line stream, cuts out a pattern in the moving web 12 as illustrated by the trajectory lines 18''. As previsously described, the jet movement is controlled by the computer 29 in which a particular pattern and size thereof is selected by the use of the keyboard 29'. Because a water jet stream is utilized to perforate the web, herein the cardboard web, there is no dust produced in the perforation. Usually these water jets operate at pressures of 40,000 to 50,000 psi. The machine of the present invention can also operate at a very high speed and is capable of cutting a minimum of four thousand discs having a diameter of 40 inches in 1 hour. Also, the machine may operate with only two of the cutting jets and cut single discs extending across the sheet, in this particular case, discs of up to 90 inches in diameter. The machine may also be used with one cutting element, such as at 18'', which is displaced on the path 2' to cut a straight line 2 across the moving web 12'as show in FIG. 4. As can be appreciated, the set up time to cut sheets of different sizes is extremely fast as one needs only to press a few keys on the computer keyboard 29'.

A slitting station 40 may also be provided adjacent the recovery end of the discharge wire conveyor 13 to slit the cuttings 31 to smaller pieces to facilitate conveying same. This slitting station 40 may comprise a single oscillating jet stream, not shown.

Figure 5A:
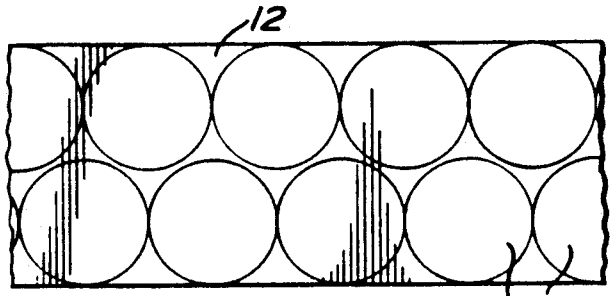
FIG. 5A to 5F are plan views showing a web having a different predetermined patterns cut therein by the machine of the present invention.
Figure 5B:
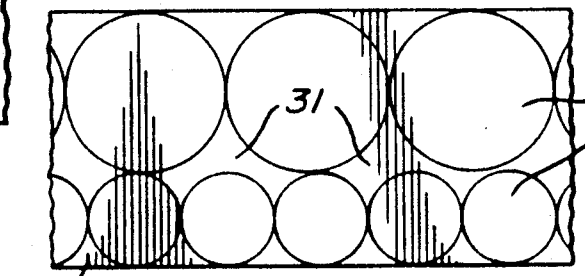
Figure 5C:
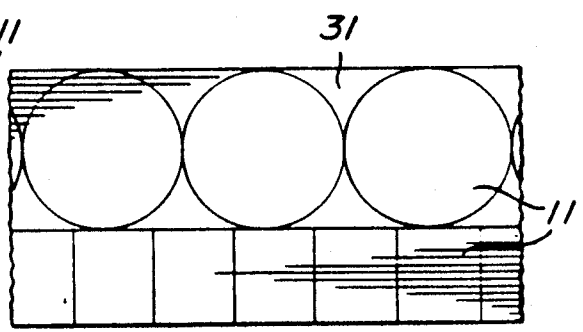
Figure 5D:
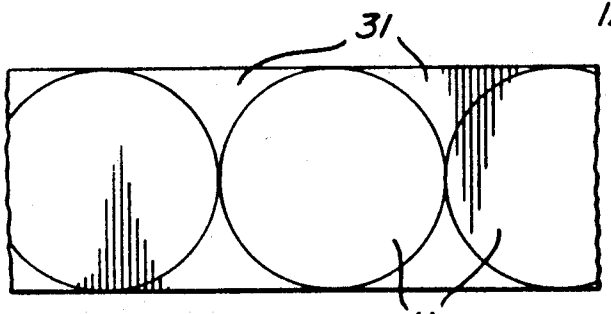
Figure 5E:
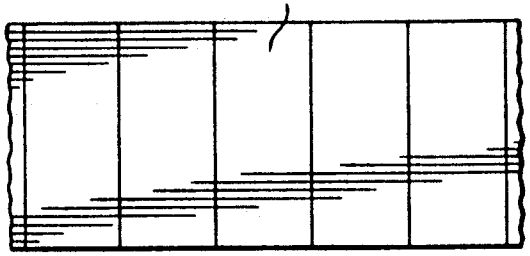
Figure 5F:
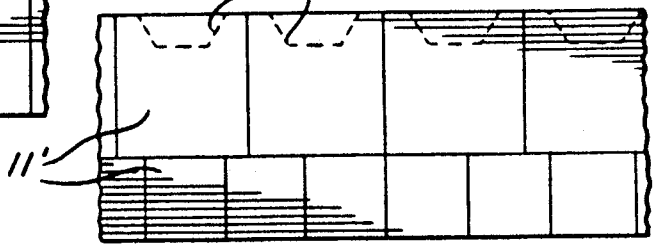

FIG. 5A to 5F show the versatility of the machine and as can be seen, it can cut various forms of patterns 11 as well as perforated patterns 41 in a web of material 12. In order to achieve the perforated score lines 41, the jet is pulsated or obstructed by a rotating disc (not shown) that would disposed in the jet stream path and obvious to a person skilled in the art. The jets may also be programmed to slit the web into square sections 11' as shown in FIG. 5C, 5B and 5E.

Briefly summarizing the method of operation of the machine, it consists of supporting a moving web of material in a flat plane, and detecting the lateral position of the web on that plane as well as the displacement speed of the web. At least one cutting element is displaced on two transverse axes in a horizontal plane adjacent a face of the web by guide means, herein guide rails 19, and controlled by automatic means, such as a computer 29. The cutting elements generate a cutting beam, herein a high pressure, hairline water jet stream, to slit a portion of a repetitive pattern through the web. The displacement and rate of speed of the cutting elements are controlled by the computer 29 whereby to cut or score configured pieces 30 in the web. The cuttings are then discharged at the end of the main conveying surface, and conveyed by the discharge conveyor 33 to a remote location. The configured pieces are then automatically conveyed and stacked.

The web of material may be comprised of paper, cardboard, aluminum or other metals, felts, etc., capable of being cut by a high speed water jet.

It is within the ambit of the present invention to cover any obvious modifications of the preferred embodiment described herein, provided such modifications fall within the scope of the appended claims.

I claim:

1. A method of cutting a predetermined repetitive pattern in a continuous moving web of material, said method comprising:

(i) supporting a moving web of material on a flat plane defined by a plurality of spaced conveyor wires;

(ii) detecting the lateral position of said web in said flat plane by sensing an edge of said web to determine said lateral position;

(iii) detecting the speed of displacement of said web;

(iv) displacing each of four cutting elements in path parallel to two transverse axes and in a horizontal plane adjacent a face of said web, said cutting elements being displaced on a respective one of four guide rails each being supported at opposed ends on pedestals, each secured to a displaceable attachment which is connected to a motor which displaces said attachment and said guide rails along the moving direction of said web;

(v) generating a cutting beam by each said cutting element which co-acts in pairs to cut said repetitive pattern through said web during a single pass to produce two adjacent configured pieces from said web of material for minimum material loss; and (vi) controlling the displacement and rate of speed of said cutting elements dependent on information signals representative of the rate of displacement and the lateral position of said edge of said web being sensed on the support means and generated by said steps (ii) and (iii) to minimize web material loss and to ensure that precise repetitive patterns are perforated in said moving web irrespective of web speed variations.

2. A method as claimed in claim 1 wherein there is provided feed roller means to advance said web over said wire support surface, said configured pieces being conveyed to a discharge end where they are stacked into a bundle.

3. A method as claimed in claim 1 wherein said cutting elements are water jets, there further being provided the step of collecting water discharged from said jets after passing through said web in a catcher follower housing aligned and displaced in synchronism with said jets.

4. A high speed cutting machine for perforating a predetermined repetitive patterin in a continuous moving web of material, said apparatus comprising conveyor means for supporting and displacing said web in a flat plane, position sensing means to sense an edge of said web to determine the lateral position of said web on said conveyor means, speed sensing means to sense the speed of displacement of said web on said conveyor means, at least four cutting elements are displaceably supported for movement along a respective one of four bridge members for independent transverse displacement across said web in a horizontal plane disposed above a face of said web, each said bridge member being supported at opposed ends on pedestals secured to a displaceable attachment which is connected to a motor which displaces said attachment and said bridge members along the moving direction of said web, each of said bridge members being displaceable along the direction of said moving web to displace its associated one of said cutting elements in the longitudinal direction of said web, said four cutting elements co-acting in pairs and each cutting element generating a cutting beam to cut a respective pattern through said web during a single pass of said web, said four cutting elements each being independently displaceable from one another to perforate two adjacent patterns across said web with minimum material loss, guide means to support each of said four cutting elements for displacement in said horizontal plane adjustment siad web which is displaced on said conveyor means, and control means for receiving information signals from said position sensing means and said speed sensing means to control the displacement and rate of speed of each of said four cutting elements dependent on the rate of displacement and the lateral position of the web on the conveyor means to minimize web material loss and to ensure that precise repetitive patterns are perforated in said moving web irrespective of web speed variation.

5. A high speed cutting machine as claimed in claim 4 wherein said cutting elements are high pressure, water jet streams having flexible conduit means connected thereto to supply water to said jets from a high pressure supply.

6. A high speed cutting machine as claimed in claim 5 wherein each of said water jets is mounted on a carriage displaceably secured on said bridge member which extends transversely over said conveyor means.

7. A high speed cutting machine as claimed in claim 5 wherein said bridge member is a straight guide rail supported at opposed ends, and a catcher follower housing mounted under said web and aligned and displaced in synchronism with said cutting elements to receive said water jet streams therein.

8. A high speed cutting machine as claimed in claim 7 wherein said position sensing means are photoelectric cells secured on a displaceable support for sensing said edge of said web, said speed sensing means being a function wheel in contact with said moving web.

9. A high speed cutting machine as claimed in claim 7 wherein said conveyor means is constituted by a main conveyor formed of a plurality of spaced support wires for supporting said web in a horizontal plane at least in a region below said moving cutting elements, and pincer feed rolls for feeding said web over said support wires.

10. A high speed cutting machine as claimed in claim 9 wherein said web is stored as a supply roll supported on a shaft at a feed end of said machine, guide rolls for feeding said web to said pincer feed rolls, said pincer feed rolls being in frictional engagement with said web to move said web at a predetermined speed, and storage means at a discharge end of said machine for automatically stacking configured pieces of material cut from said web.

11. A high speed cutting machine as claimed in claim 4 wherein said control means is a programmable computer controlling the operation of said cutting elements, and including a keyboard to select a desired configuration and size of material pieces to be cut from said web.

* * * * *

UNITED STATES PATENT AND TRADEMARK OFFICE

CERTIFICATE OF CORRECTION

PATENT NO. : 5,083,487

DATED : January 28, 1992

INVENTOR(S) : Rene Croteau

It is certified that error appears in the above-identified patent and that said Letters Patent is hereby corrected as shown below:

On the title page:
The Foreign Application Priority Data are incorrect, should be, --Aug. 8, 1989 [CA] Canada .....607,708--.

Signed and Sealed this

First Day of June, 1993

*Attest:*

Michael K. Kirk

MICHAEL K. KIRK

*Attesting Officer*

*Acting Commissioner of Patents and Trademarks*